US007394400B2

(12) United States Patent
Tauchi

(10) Patent No.: US 7,394,400 B2
(45) Date of Patent: Jul. 1, 2008

(54) VEHICLE COMMUNICATION APPARATUS AND SYSTEM FOR SUPPORTING VEHICLES PASSING THROUGH NARROW ROAD

(75) Inventor: Nobutaka Tauchi, Toyoake (JP)

(73) Assignee: DENSO CORPORATION, Kariya (JP)

( * ) Notice: Subject to any disclaimer, the term of this patent is extended or adjusted under 35 U.S.C. 154(b) by 209 days.

(21) Appl. No.: 11/362,808

(22) Filed: Feb. 28, 2006

(65) Prior Publication Data

US 2006/0208923 A1 Sep. 21, 2006

(30) Foreign Application Priority Data

Mar. 11, 2005 (JP) ..... 2005-069676

(51) Int. Cl.
*G08G 1/00* (2006.01)

(52) U.S. Cl. ..... 340/901; 340/903; 340/905; 340/988; 701/1; 701/300; 701/301

(58) Field of Classification Search ..... 340/901, 340/902, 903, 904, 905, 906, 928, 935, 435, 340/436, 988; 701/1, 200, 301
See application file for complete search history.

(56) References Cited

U.S. PATENT DOCUMENTS 6,434,480 B1 * 8/2002 Kubota et al. ..... 701/207
6,445,308 B1 9/2002 Koike
6,801,138 B2 10/2004 Koike
6,861,957 B2 3/2005 Koike
6,985,089 B2 * 1/2006 Liu et al. ..... 340/903
2003/0098800 A1 * 5/2003 Jambhekar et al. ..... 340/901
2005/0073430 A1 * 4/2005 Kusters et al. ..... 340/901
2006/0192687 A1 * 8/2006 Konishi et al. ..... 340/901

FOREIGN PATENT DOCUMENTS

JP H11-083508 3/1999
JP 2000-276696 10/2000
JP 2004-245610 9/2004

* cited by examiner

*Primary Examiner*—Davetta W. Goins
*Assistant Examiner*—Kerri L McNally
(74) *Attorney, Agent, or Firm*—Posz Law Group, PLC

(57) ABSTRACT

In the car navigation system including a vehicle communication apparatus mounted on a vehicle, different diffusion codes are assigned to each road such as a single lane road and a road with double lanes. In data transmission to other vehicles, each vehicle switches to and uses the diffusion codes assigned to the road on which own vehicle currently travels. Even if many on-coming vehicles travel in line, radio wave interference between the vehicles does not occurs and the lacking of communication channels also does not occurs because each vehicle uses the diffusion codes assigned to the road on which own vehicle travels.

17 Claims, 9 Drawing Sheets

VEHICLE COMMUNICATION APPARATUS AND SYSTEM FOR SUPPORTING VEHICLES PASSING THROUGH NARROW ROAD

CROSS-REFERENCE TO RELATED APPLICATIONS

This application is related to and claims priority from Japanese Patent Application No. 2005-069676 filed on Mar. 11, 2005, the contents of which are hereby-incorporated by reference.

BACKGROUND OF THE INVENTION

1. Field of the Invention

The present invention relates to a vehicle communication apparatus for performing radio communication between vehicles on roads and a system for supporting vehicles, namely, drivers on the vehicles which pass through a narrow road, and in particular, relates to the vehicle communication apparatus and the system that are incorporated in a car navigation system mounted on each vehicle.

2. Description of the Related Art

Recently, there have been reported many techniques using a vehicle communication apparatus. For example, there are three prior art documents that have disclosed following techniques, in Japanese patent laid open publications (a) JP2000-276696, (b) JP-H11-83508, and (c) JP2004-245610. Such a conventional vehicle communication apparatus assists the vehicle to communicate with other vehicles.

The prior art document (a) JP2000-276696 has disclosed a vehicle collision evading control apparatus. The apparatus is capable of receiving position data of an on-coming vehicle and possibility data of the presence of the on-coming vehicle. The apparatus then calculates a possibility of collision and time and a position of the predicted collision between the driver's vehicle and the on-coming vehicle based on the received data. Further, the apparatus informs those predicted data items to the driver of the vehicle in order to avoid the vehicle collision.

The prior art document (b) JP-H11-83508 has disclosed a car navigation system. The apparatus is equipped with a radio communication means or a radar detection means capable of detecting an on-coming vehicle on a narrow road such as a mountain path. Those means then calculate a predicted point on the narrow road on which own vehicle and the on-coming vehicles are passing through each other. The radio communication means then informs the predicted point to both the drivers of its own vehicle and the on-coming vehicle.

The prior art document (c) JP2004-245610 has disclosed a car navigation system capable of detecting a presence of an on-coming vehicle using a vehicle communication apparatus for communicating with vehicles. The apparatus detects the presence of an on-coming vehicle traveling in a narrow area on a road where both vehicles cannot pass through each other when one vehicle approaches within a given distance measured from the narrow area on the road or when one vehicle is traveling on the narrow area. The apparatus calculates and then informs an optimum predicted point where the vehicle and the on-coming vehicle would be passing through each other.

FIG. 9A shows a road map where there are a wide road 2A having double traffic lanes, a narrow road 1*a* of a single traffic lane, and a wide road 2B having double traffic lanes. The narrow road 1*a* is a road where it is difficult for opposing vehicles to pass through each other and only a single vehicle can pass through it. Each of the wide roads 2A and 2B is a road where it is easy for opposing vehicles to pass through each other.

When a vehicle A that stops on the wide road 2A near the narrow road 1*a* and travels to the wide road 2B through the narrow load 1*a*, the vehicle A must be wait for a long time period until the tail vehicle E in the on-coming vehicles B to E passes through the narrow road 1*a*. In this case, even if using the conventional communication apparatus described above, although the vehicle A can recognize the position and running state of the vehicles B to E, it is impossible to solve the problem in which the vehicle A must be wait at the point on the wide road 2A near the narrow road 1*a* until the tail vehicle E passes through the narrow road 1*a* completely.

For example, the stop vehicle A transmits a request to stop the on-coming vehicles D and E on the wide road 2B near the narrow road 1*a*. Even if the vehicle A on the wide road 2A receives information regarding the stop of the vehicles D and E on the wide road 2B according to the request transferred from the vehicle A and thereby recognizes that the vehicles D and E stop on the wide road 2B, the vehicle A can not approach to and pass through the narrow 1*a* and the wide road 2B until the vehicles B and C have passed through the narrow road 1*a*. The vehicle can thereby pass through the narrow road 1*a* without waiting until the tail vehicle E passes through the narrow road 1*a*.

However, in the case shown in FIG. 9B where plural on-coming vehicles B to H travel in train on the narrow road 1*a* and the wide road 2B, there causes various problems such as a communication channel shortage or radio interference. The communication channel shortage means the lacking of the number of channels in radio communication. When those problems occur, the vehicle A can communicate with only some of the on-coming vehicles, for example, with the vehicle B and the vehicle E, but cannot communicate to all of the on-coming vehicles B to H. In this case, the vehicle A can not communicate with the on-coming vehicles G and E in order to send the request to stop the on-coming vehicles G and H. Further, a display device incorporated in the vehicle A cannot display the presence of the vehicles G and H traveling on the wide road 2B. That is, the display device on the vehicle A displays only the positions of the on-coming vehicles B to E and own vehicle A, but cannot display the presence of the vehicles g and H, as shown in FIG. 8C.

SUMMARY OF THE INVENTION

It is an object of the present invention to provide a new and improved a vehicle communication apparatus and a system for supporting vehicles passing through a narrow road where it is difficult for vehicles to pass through each other.

To achieve the above purposes, the present invention provides a vehicle communication apparatus mounted on a vehicle performing communication with other vehicles using given transmission channels and receiving channels. The vehicle communication apparatus has a road recognition means, a transmission channel switching means, and vehicle communication means. The road recognition means is configured to recognize a road on which own vehicle currently being. The transmission channel switching means is configured to switch a current transmission channel to a transmission channel assigned to the road recognized by the road recognition means. The vehicle communication means is configured to communicate with other vehicles and to transmit information using the transmission channel switched by the transmission channel switching means to other vehicles including on-coming vehicles on at lease one road of a first road and a second road, the first road on which two vehicle can hardly pass through each other, and the second road on which two vehicles can pass through each other.

The vehicle communication apparatus to be mounted on each vehicle switches to the transmission diffusion codes assigned to the road on which its own vehicle travels and transmits to other vehicles various information. Difference transmission diffusion codes are assigned to each road.

According to the present invention, even if many on-coming vehicles travel in line, each vehicle uses different transmission diffusion codes assigned to the road on which its own vehicle travels. If there is no unused transmission diffusion code assigned to the road on which its won vehicle travels, the radio wave interference does not occurs between other vehicles that are currently travel in a same direction on the road because the vehicle communication apparatus mounted on each vehicle inhibits the data transmission using the transmission diffusion codes assigned to the road. Thus, the vehicle equipped with a car navigation system having the vehicle communication apparatus according to the present invention can avoid any occurrence of radio interference between the vehicles and avoid the lacking of communication channels.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
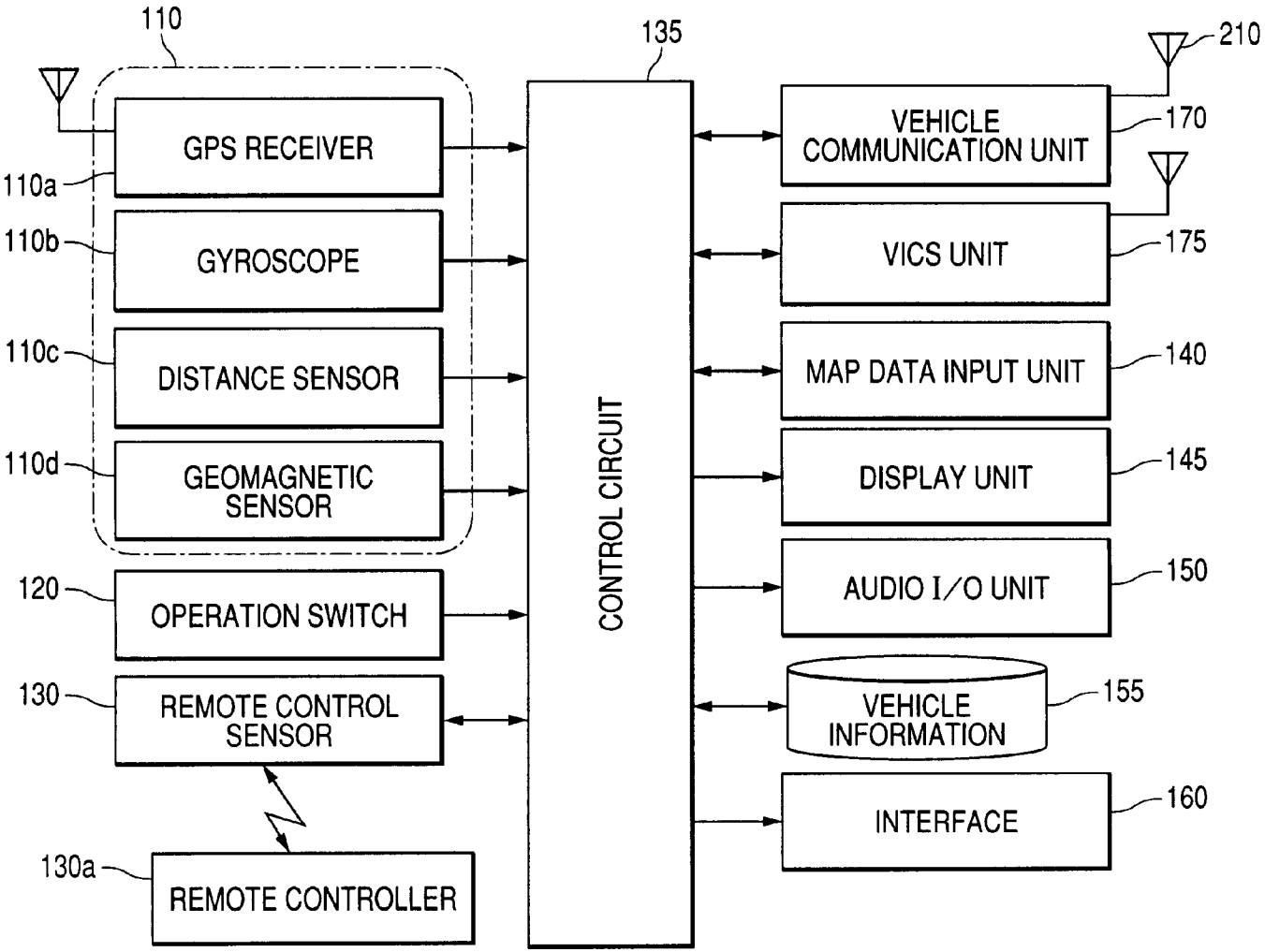
FIG. 1 is a block diagram showing the schematic configuration of a car navigation system including a vehicle communication apparatus and a system for supporting vehicles passing through a narrow road according to a first embodiment of the present invention.

Hereinafter, various embodiments of the present invention will be described with reference to the accompanying drawings. In the following description of the various embodiments, like reference characters or numerals designate like or equivalent component parts throughout the several views.

Embodiment

A description will now be given of the configuration and operation of the vehicle communication apparatus for communicating between vehicles and the car navigation system for supporting vehicles passing through a narrow road according to a first embodiment of the present invention.

Through the following description, the vehicle communication is performed between vehicles. Each vehicle is equipped with the car navigation system. The car navigation system is equipped with the vehicle communication apparatus and the system for supporting vehicles passing through a narrow road according to the present invention. The system supports vehicles or drivers of the vehicles passing through a narrow road with a single lane on which own vehicle and an on-coming vehicle cannot pass through each other.

FIG. 1 is a block diagram showing a schematic configuration of the car navigation system equipped with the vehicle communication apparatus and the system for supporting vehicles passing through a narrow road according to the embodiment of the present invention.

As shown in FIG. 1, the car navigation system 10 has a position detector 110, operation switches 120, a remote control sensor 130, a remote control terminal 130*a* (hereinafter referred to as "a remote controller"), a map data input unit 140, a display unit 145, an audio input/output unit 150, a vehicle information unit 155, an interface 160, the vehicle communication apparatus 170, a VICS (Vehicle Information Communication System) unit 175, and a control circuit 135 connected to the above devices.

The control circuit 135 is a micro computer that is commercially available. The micro computer has a CPU(Central Processing Unit), a ROM (Read Only Memory), a RAM (Random Access Memory), I/O (Input/Output) interface, and bus lines (omitted from drawings) through which those units are connected. The ROM stores various programs in advance by which various functions are executed in the car navigation system. The CPU performs given arithmetic operations based on the programs.

The vehicle communication apparatus 170 performs communication between vehicles by transmitting and receiving information based on spectrum diffusion scheme such as CDMA (Code Division Multiple Access). The vehicle communication apparatus 170 transmits and receives information using different diffusion codes for transmission and reception (transmission diffusion codes and reception diffusion codes) transferred from the control circuit 135.

The position detector 110 is a well known apparatus composed of a GPS (Global Positioning System) receiver 110*a*, a gyroscope 110*b*, a distance sensor 110*c*, and a magnetic field sensor 110*d*. The GPS receiver 110*a* detects a position of own vehicle based on a radio wave transmitted from a satellite. Because those sensors involve own different measurement errors, those sensors are configured to interpolate those errors to each other. For example, it is acceptable to use the above sensors as the position detection sensor 1 according to the degree of precision of the position detection sensor 1, or possible to use the rotary sensor of a steering, a speed sensor, or a rotary speed sensor of a driving wheel (not shown).

A touch switch integrated with the display unit 145 or a mechanical switch is used as the operation switch 120 through which the driver scrolls map data displayed on the display unit 145 and inputs various kinds of characters.

The map data input unit 140 is an input device for inputting map data composed of road data, index data, plotted data. The map data input unit 140 transfers those data items according to the request from the control circuit 135.

The recording medium for storing those map data items is a CR-ROM, or a DVD-ROM in general. Instead of those, it is acceptable to use a writable recording medium such as a memory card, a hard disk device and so on.

A description will now be given of link data and node data forming the road data.

First, a link is defined as a line between two nodes. The node is an intersection and a junction through which roads on a map are joined to each other. The link data item is composed of an inherent identification number (link ID) of each link, a link length, coordinates (latitude, longitude) of the start node and the terminal point of each link, the name of a road, the type of a road, a traveling time for a link, a diffusion code to be used for a transmission channel by the vehicle communication apparatus 70, and other data items. Through the following description, transmission codes assigned to each road will be used as transmission channels to be used in transmission communication by the vehicle communication apparatus 170 in the car navigation system 10 mounted on each vehicle. In addition, the single lane road 1*a* corresponds to the first road and the roads 2A and 2B with double lanes correspond to the second road according to the present invention.

Different transmission diffusion codes of a given number are assigned to each road such as a single lane road as a narrow road and a road with double lanes as an approach road joined to the single lane road. On the road with double lane, two vehicles can pass through each other easily.

The control circuit 135 searches the load corresponding to the current position of own vehicle detected by the position detector 110 based on the road data items, and obtains the transmission diffusion codes and the reception diffusion codes that are assigned for the load. The control circuit 135 transfers those diffusion codes to the vehicle communication apparatus 170.

On the other hand, the node data is composed of an inherent node identification number (node ID) assigned to each node, a node coordinate (latitude, longitude), and a connection link ID including the link ID for all of the links joined to the node.

The display unit 145 is composed of a liquid crystal display, for example. The display 145 displays the position mark of own vehicle and a road map around the road on which own vehicle is traveling. The position mark of own vehicle indicates the current position of own vehicle detected by and transferred from the position detector 110. The road map near the won vehicle is generated based on the map data inputted by the map data input unit 140.

The audio input/output unit 150 has a microphone and a speaker (not shown). The audio input/output unit 150 outputs the audio data obtained through the microphone to the control circuit 135. The control circuit 135 recognizes the contents of the audio data from the driver of the vehicle and transfers the control data to the various units in the car navigation system 10. The speaker outputs synthetic sound and evocation sound generated by the control circuit 135.

The vehicle information storage unit 155 is composed of a memory medium (not shown) for storing data items relating to information of own vehicle. The interface 160 is a hardware connected to external devices (not shown).

The VICS device 175 receives traffic information provided from a VICS (Vehicle Information and Communication System) center through beacons embedded in a road and FM broadcasting stations in each area.

The control circuit 135 receives the traffic information and then processes the received information. For example, the display unit 145 displays traffic jam information and traffic control information overlapped on the road map.

The vehicle communication apparatus 170, as described above, performs the transmission and reception of data based on a spectrum diffusion scheme such as CDMA.

Next, a description will now be given of the configuration of the vehicle communication apparatus 170 with reference to FIG. 2.

Figure 2:
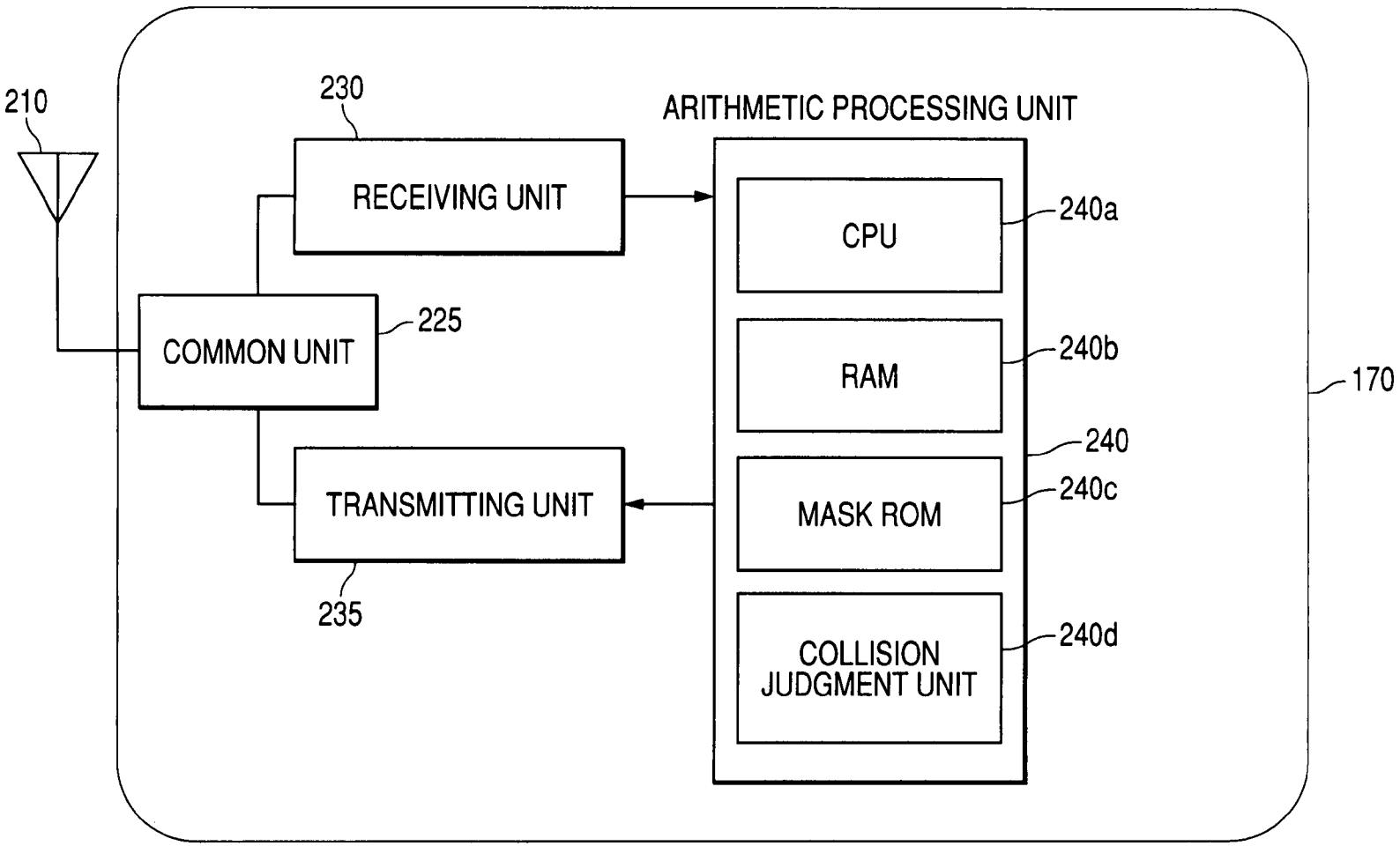
FIG. 2 is a diagram showing the configuration of the vehicle communication apparatus in the car navigation system shown in FIG. 1.

As shown in FIG. 2, the vehicle communication device 170 has an antenna 210, a common unit 225, a receiving circuit 230, a transmitting circuit 235, and an arithmetic processing unit 240.

The antenna 210 is an antenna for transmission and reception of information. Both the receiving circuit 230 and the transmitting circuit 235 use the common unit 225. The common unit 225 performs conversion and amplification of signals.

The receiving circuit 230 and the transmitting circuit 235 assign to information the transmission diffusion codes and reception diffusion codes instructed or transferred from the arithmetic processing unit 240 and then perform the reception and transmission of the information including those diffusion codes.

Those transmission diffusion codes and reception diffusion codes indicated by the arithmetic processing unit 240 are the transmission diffusion codes and reception diffusion codes, respectively, transferred from the control circuit 135.

Based on the road information, the vehicle communication apparatus 170 can recognize the transmission channel assigned to the road on which own vehicle is currently traveling, and selects or switches the current diffusion code to the transmission diffusion code to be used for the transmission channel.

As described above in detail, the present embodiment performs the transmission for information using the transmission diffusion codes in the communication based on the spectrum diffusion scheme.

However, the present invention is not limited by the communication based on the spectrum diffusion scheme. It is possible to use channels based on a frequency of FDMA (Frequency Division Multiple Access) scheme, a time slot of TDMA (Time Division Multiple Access) scheme, and an orthogonal frequency of OFDM (Orthogonal Frequency Division Multiplexing), for example.

The arithmetic processing unit 240 has a CPU 240*a*, a RAM 240*b*, a mask ROM 240*c*, and a collision judgment unit 240*d*. The collision judgment unit 240*d* judges occurrence of a collision based on the information received by the receiving circuit 230. The receiving circuit 230 judges the occurrence of a collision based on a driving direction, a current position, and a speed of another vehicle, and a driving direction, a current position, and a speed of own vehicle.

The car navigation system 10 having the above configuration mounted on each vehicle assigns different transmission diffusion codes for each road such as a single lane road 1*a* and roads 2A and 2B with double lanes (a road with double lanes), and switches to the transmission diffusion code assigned to the road on which own vehicle is currently traveling, and transmits to other vehicles information using the transmission diffusion code switched. This is one of the important features of the present invention.

Figure 3A:
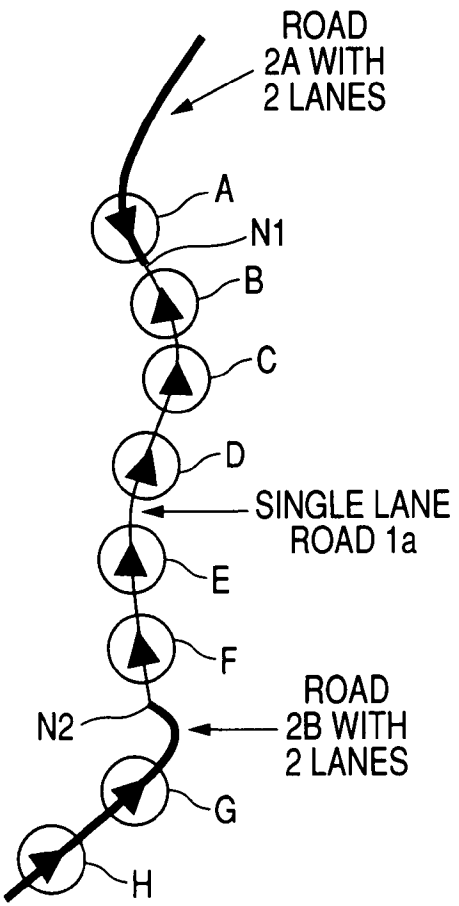
FIG. 3A to FIG. 3C are diagrams showing the use of transmission diffusion codes by a stop vehicle and other on-coming vehicles until the stop vehicle A on the road 2A with double lanes approaches the single lane road 1*a* as a narrow road.

For example, as shown in FIG. 3A, the vehicle A is traveling on the road 2A with double lanes and plural on-coming vehicles B to H are traveling on the single lane road 1*a* and the road 2B with double lanes. Each vehicle uses difference transmission codes assigned to each road on which own vehicle is traveling. Thereby, the radio wave interference between the vehicles and the lacking of un-used channel do not happen.

As a result, the stop vehicle A can perform the recognition of the position of the on-coming vehicle on the single lane road 1*a* and the position of each on-coming vehicle on the road with double lanes, and also perform bidirectional or two-way communication. In addition, because the vehicles on both the roads 2A and 2B with double lanes use the transmission diffusion codes corresponding to the traveling direction to the single lane road 1*a* in communication, it is possible to specify based on the reception diffusion codes the vehicle that approaches the single lane road 1*a* from which road with double lanes.

The car navigation system 10 mounted on the vehicle switches to the transmission diffusion codes and the reception diffusion codes to be used by the following manner.

For example, as shown in FIG. 3A, the on-coming vehicle G on the road 2B with double lanes recognizes and obtains an unused transmission diffusion code in all of the transmission diffusion codes of a given number assigned to the road 2B with double lanes. That is, the vehicle G communicates data using all of the transmission diffusion codes assigned to the road 2B with double lanes. The vehicle G recognizes the presence of the unused transmission diffusion code based on the failure of the communication. The transmitting circuit 235 in the vehicle communication apparatus 170 switches the current diffusion code to the unused transmission diffusion code. Thus, the apparatus 170 can recognizes the transmission diffusion code that other vehicles do not use.

Unfortunately, if all of the transmission diffusion codes assigned to the road on which own vehicle is traveling, the vehicle communication apparatus 170 of own vehicle determines and obtains one of the currently used transmission diffusion codes according to the order of release. That is, as shown in FIG. 3A, because the on-coming vehicle D on the single lane road 1*a* determines, as the transmission diffusion code to be used, the diffusion code that is currently used by the on-coming vehicle B that can pass firstly through the single lane road 1*a*.

The transmitting circuit 235 in the vehicle communication apparatus 170 switches the currently used diffusion code to the transmission diffusion code determined above and halts the use of the switched diffusion code until the on-coming vehicle B releases the transmission diffusion code, namely until the on-coming vehicle B passes through the single lane road 1*a*.

As described above, if there is no unused transmission diffusion code, it is prohibited to perform the transmission of information using the transmission diffusion code. Thereby, it can be avoided to cause any radio interference between the on-coming vehicles, namely between the preceding vehicle and the following vehicle on the same road in a same direction.

On the other hand, because the data reception using reception diffusion codes between vehicles does not occur radio wave interference, it is possible to use all of the transmission diffusion codes assigned to the all of the roads such as the single lane road 1*a*, the road 2A with double lane, and the road 2B with double lane (roads 2A and 2B are joined to the single lane road 1*a*) as the reception diffusion codes to be used by the receiving circuit 230 in the vehicle communication apparatus 170, regardless of the use of the diffusion codes by the other vehicles.

The receiving circuit 230 in the vehicle communication apparatus 170 switches the current diffusion code to the transmission diffusion code as the reception diffusion code described above. It is thereby possible to receive the information form the other vehicles.

Next, a description will now be given of the operation of the system for supporting vehicles passing through the single lane road 1*a* as a narrow road while the vehicle communication is performed between plural vehicles, each equipped with the car navigation apparatus 170 having the above configuration.

As a concrete example, it will be explained that each vehicle approaches to and passes through the single lane road 1*a* from one of the roads 2A and 2B with double lanes, as shown in FIG. 3A.

Figure 3B:
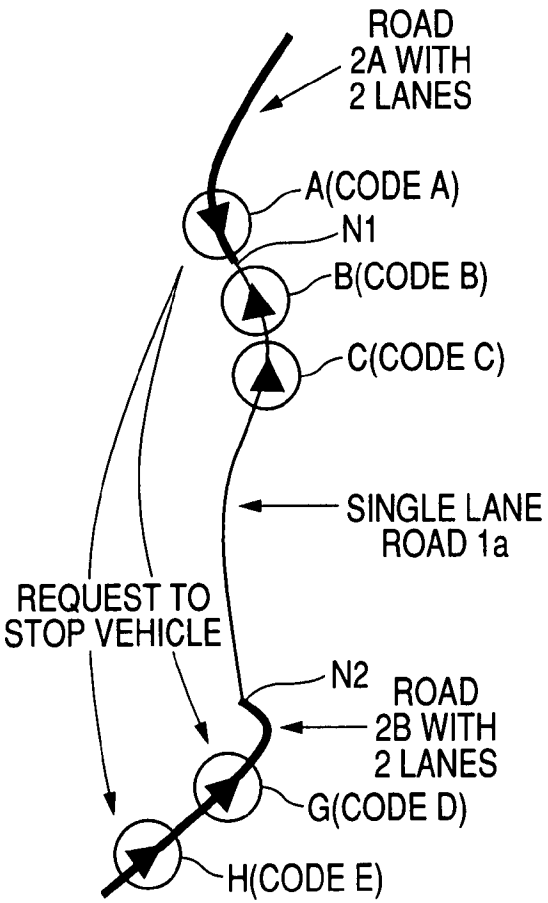
Figure 3C:
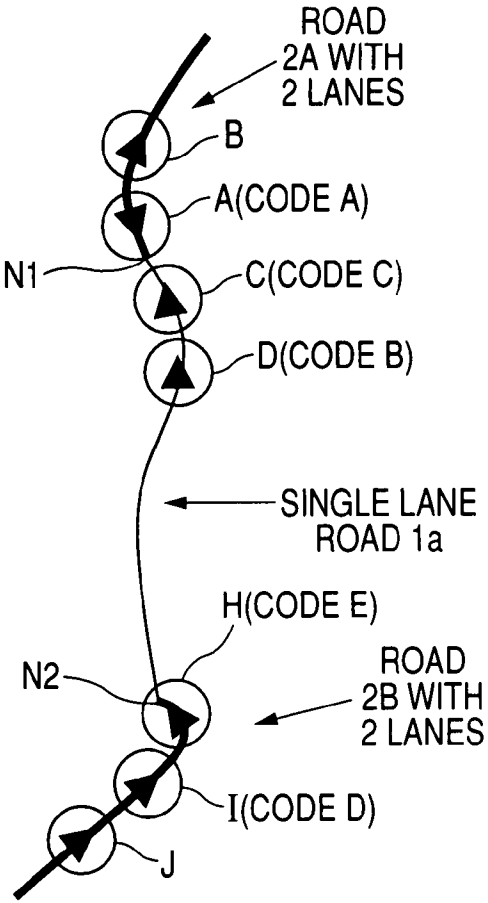
Figure 4A:
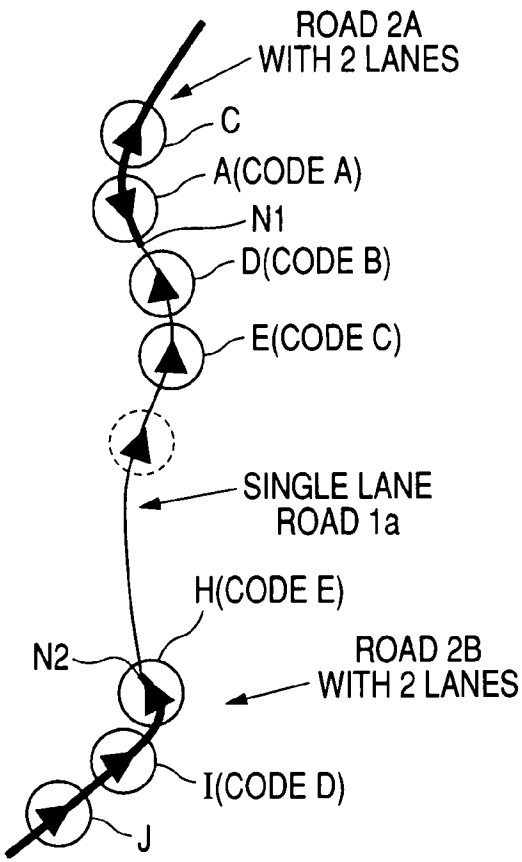
FIG. 4A to FIG. 4C are diagrams showing the use of transmission diffusion codes by the stop vehicle and other on-coming vehicles until the stop vehicle A on the road 2A with double lanes approaches the single lane road 1*a* as a narrow road.
Figure 4B:
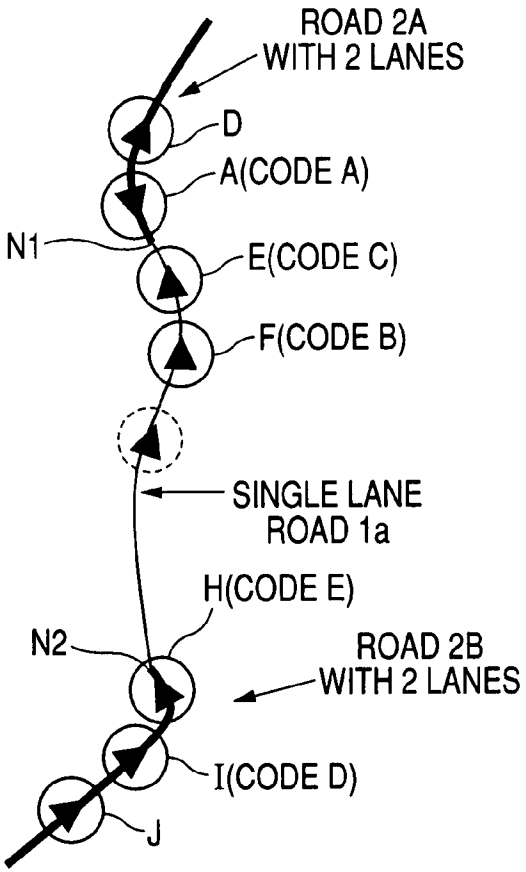
Figure 4C:
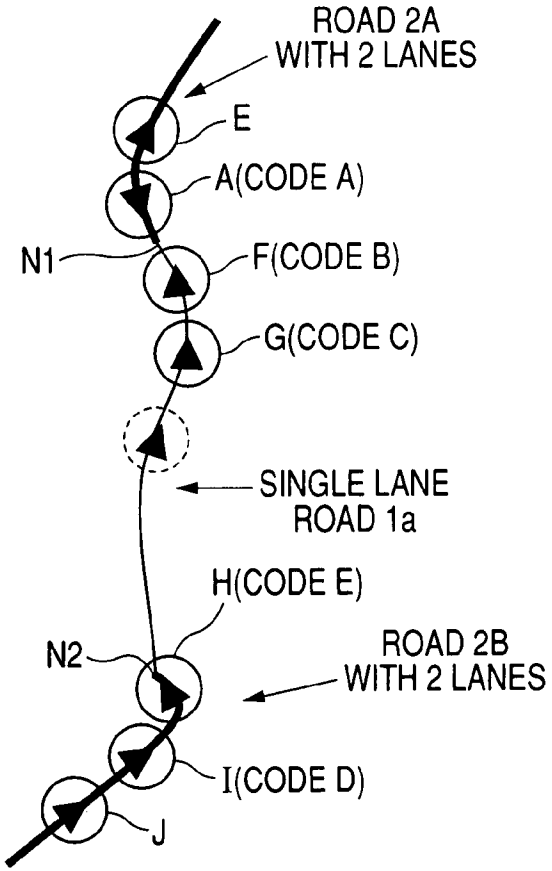
Figure 5A:
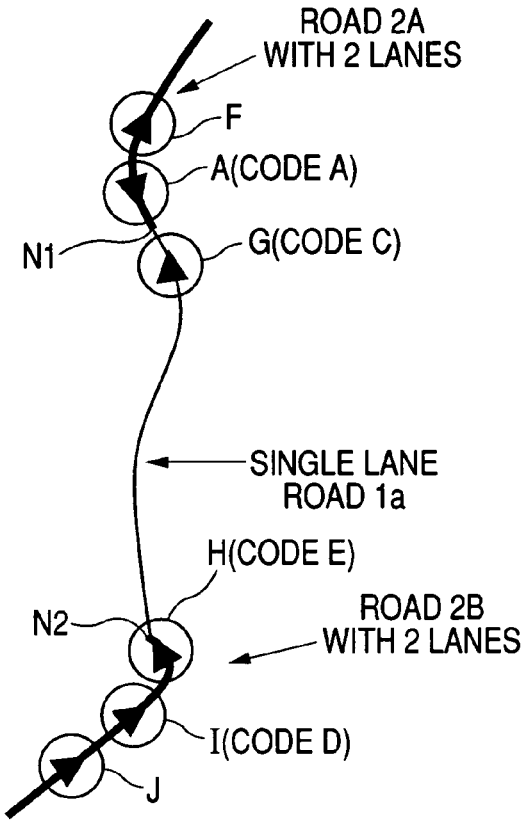
FIG. 5A and FIG. 5B are diagrams showing the use of transmission diffusion codes by the stop vehicles and other on-coming vehicles until the stop vehicle on the road 2A with double lanes approaches and enters the single lane road 1*a* as a narrow road.
Figure 5B:
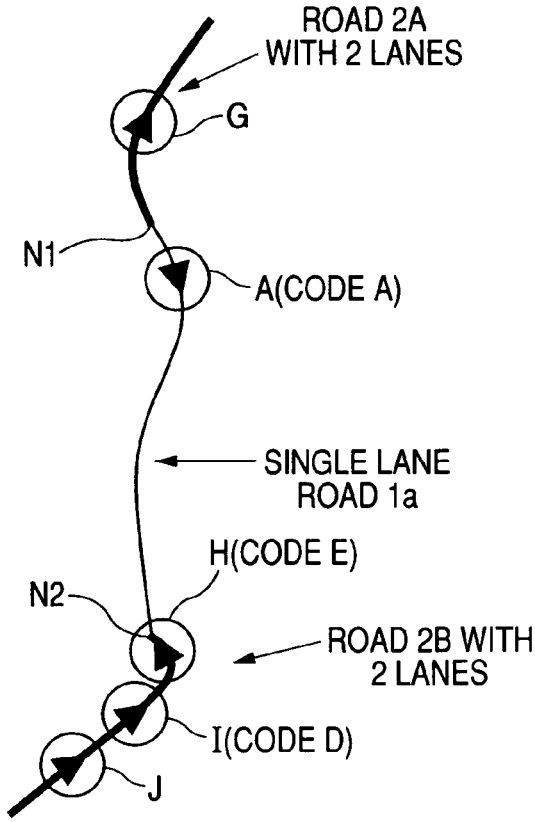

FIG. 3A to FIG. 3C are diagrams showing the use of transmission diffusion codes by the stop vehicle A and other on-coming vehicles until the stop vehicle A on the road 2A with double lanes approaches the single lane road 1*a* as a narrow road. FIG. 4A to FIG. 4C are diagrams showing the use of transmission diffusion codes by the stop vehicle A and other on-coming vehicles until the stop vehicle A on the road 2A with double lanes approaches the single lane road 1*a* as a narrow road. FIG. 5A and FIG. 5B are diagrams showing the use of transmission diffusion codes by the stop vehicles A and other on-coming vehicles until the stop vehicle A on the road 2A with double lanes approaches and enters the single lane road 1*a* as a narrow road.

In the following explanation, the transmission diffusion code A (code A) is assigned to the road 2A with double lanes, the transmission diffusion codes B and C (code B and code C) are assigned to the single lane road 1*a*, and the transmission diffusion codes D and E (code D and code E) are assigned to the road 2B with double lanes.

Basically, each vehicle including the stop vehicle A and other on-coming vehicles always transmit to other vehicles information such as a running direction, a current position, and a speed of own vehicle and also received information from, other vehicles.

Figure 6:
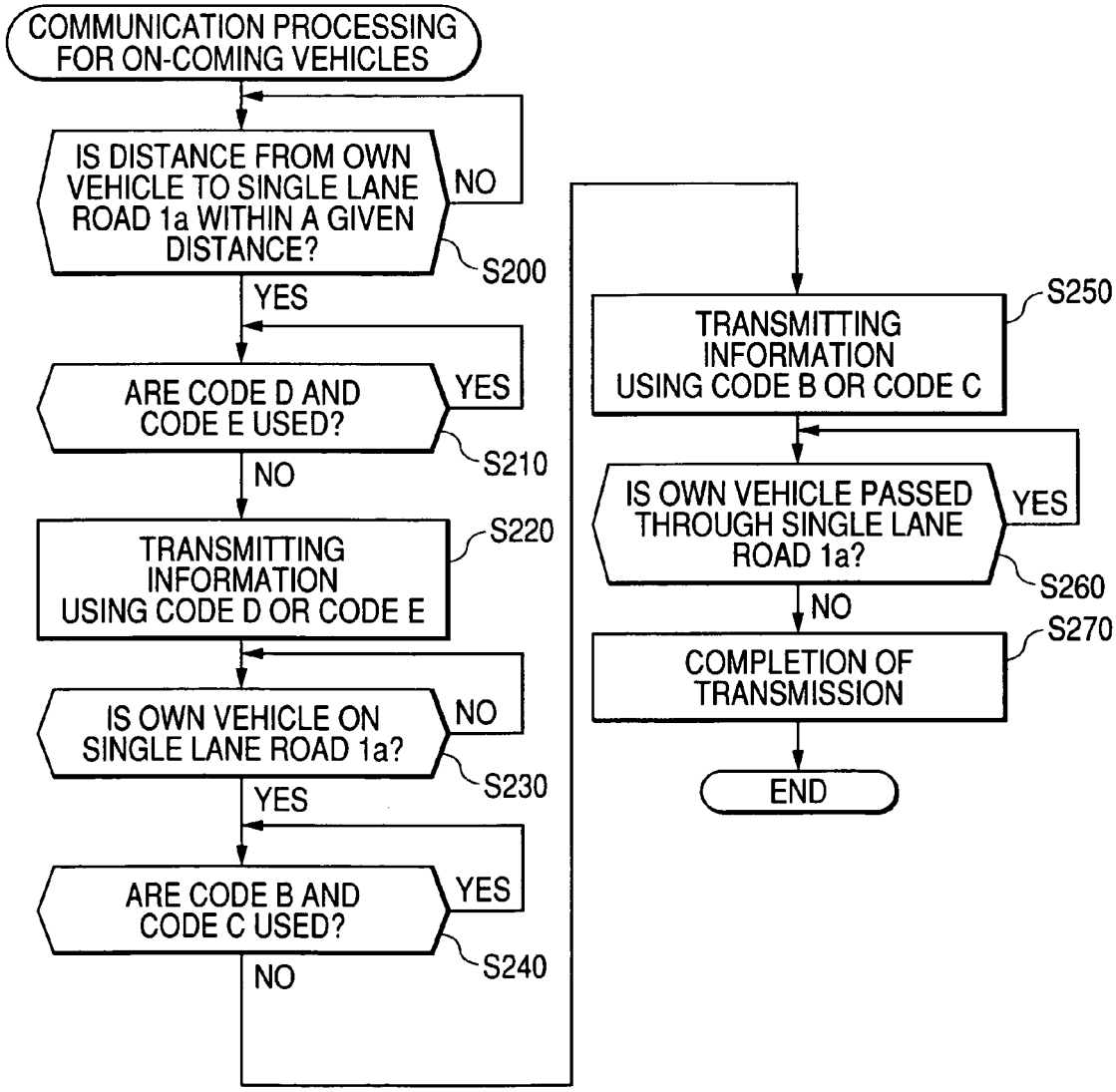
FIG. 6 is a flowchart showing the operation flow of radio communication for the on-coming vehicles.

FIG. 6 is the flowchart showing the operation flow of radio communication for the on-coming vehicles other than the stop vehicle A.

First, the operation of the on-coming vehicles G and H on the road 2B with double lanes that approach the single lane road 1*a* will be explained with reference to the flow chart shown in FIG. 6. Each of the on-coming vehicles G and H and the stop vehicle A is equipped with the car navigation system 10 including the vehicle communication apparatus 170 shown in FIG. 1 and FIG. 2.

In step S200 of FIG. 6, it is judged whether or not own on-coming vehicle G is reached within a given distance measured from the joint node N2 (see FIG. 3A) between the single lane road 1*a* and the road 2B with double lanes. In step S200, the judgment result indicates YES, namely the on-coming vehicle G is reached within the given distance measured from the joint node N2, the operation flow goes to step S210. If the judgment result indicates NO, the operation flow halts until the judgment result indicates YES. This judgment performs using the map data and the current position of the on-coming vehicle G. If the judgment result indicates YES, the operation flow goes to step S210.

In step S210, the vehicle communication apparatus 170 mounted on the on-coming vehicle G switches to all of the transmission diffusion codes (code D and code E) assign to the road 2B with double lanes and also switches as the reception diffusion code to all of the reception diffusion codes assigned to the single lane road 1*a* and the roads 2A and 2B with double lanes. It is then judged whether or not the codes D and E are currently used.

When the judgment result indicates YES, namely those codes D and E are now used, it is prohibited to perform the communication using the transmission diffusion codes D and E and only the data reception is performed using the reception diffusion codes.

On the contrary, the judgment result indicates NO in step S210, namely, those codes D and E are not used currently, the operation flow goes to S220 and the vehicle communication apparatus 170 mounted on the on-coming vehicle G performs the transmission of information regarding own vehicles using the transmission diffusion code D or code E.

In step S230, it is judged whether or not the on-coming vehicle G approaches into the single lane road 1*a*. If YES, the operation flow goes to step S240. If NO, namely, the on-coming vehicle G is not on the single lane road 1*a*, the operation halts until the on-coming vehicle G approaches and enters the single lane road 1*a*. This judgment performs using the map data and the current position of own vehicle.

In step S240, the apparatus 170 mounted on the vehicle G switches to the transmission diffusion code B or code C that are assigned to the single lane road 1*a*. It is then judged whether or not the codes B and C are currently used by other vehicles.

When the judgment result indicates YES, namely those codes B and C are now used, it is prohibited to perform the transmission of information regarding own on-coming vehicle G using the transmission diffusion codes B and C. On the contrary, the judgment result indicates NO, namely, those codes B and C are not used currently, the operation flow goes to S250 and the vehicle communication apparatus 170 mounted on the vehicle G performs the transmission of information regarding own on-coming vehicles G using the unused transmission diffusion code B or code C.

In step S260, it is judged whether or not the on-coming vehicle G is traveling on the road 2A with double lanes after through the single lane road 1*a*. If YES, the operation flow goes to step S270. In step S270, the transmission communication using the transmission diffusion code B or code C is completed. Following, another vehicle being on the single lane road la initiates the transmission of information using the transmission diffusion code B or code C assigned to the single lane road 1*a*.

As described above, it is then judged whether or not the transmission of information using the codes B and C are completed based on the map data and the current position of own vehicle.

Next, a description will now be given of the operation of the stop vehicle A equipped with the navigation system 10 shown in FIG. 2 with reference to the flow chart shown in FIG. 7.

Figure 7:
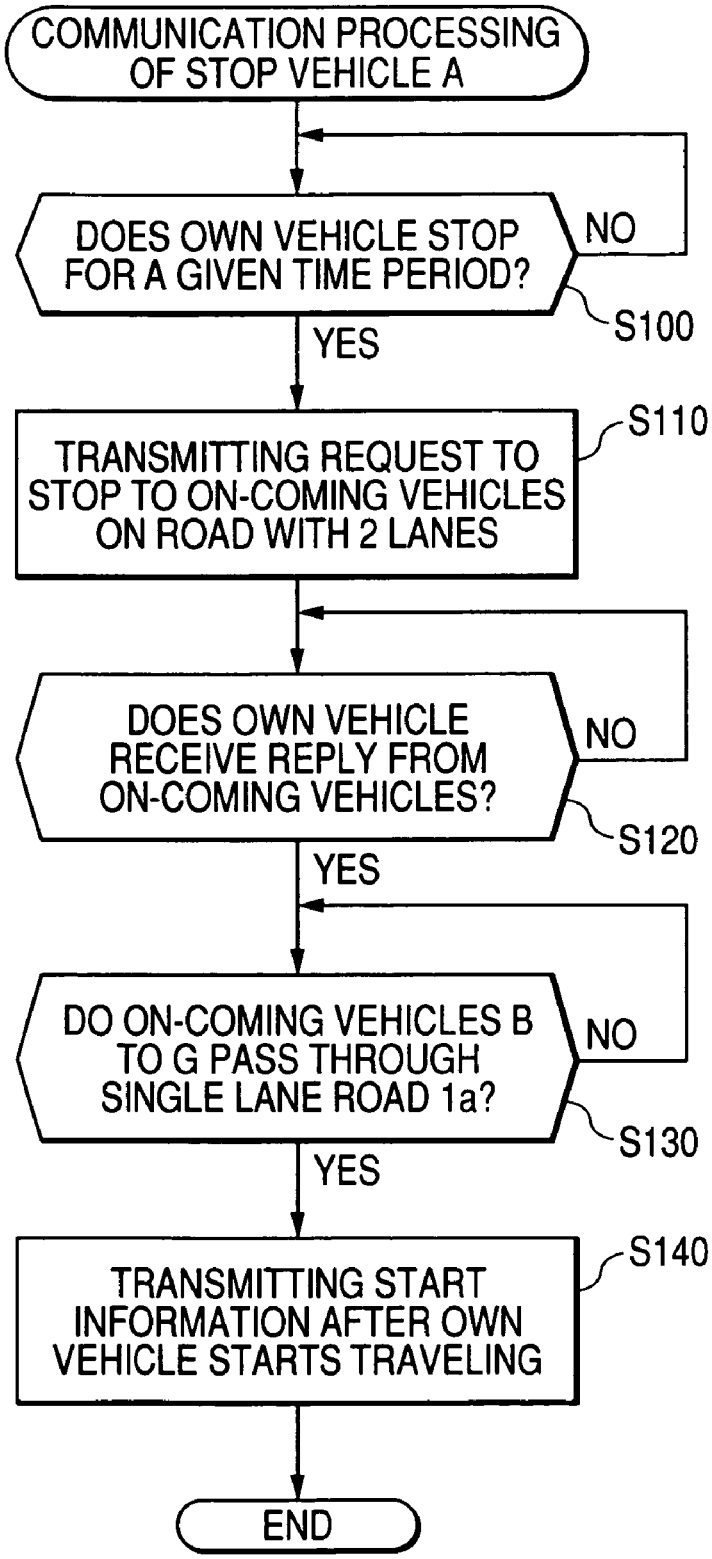
FIG. 7 is a flowchart showing the operation flow of radio communication for own vehicle A and the on-coming vehicles.

In step S100 shown in FIG. 7, it is judged whether or not the stop vehicle A reaches within the given distance measured from the joint node N1 between the single lane road 1*a* and the road 2A with double lanes, and also judged whether or not the vehicle A stops on the road 2A with double lanes for a given time period. If YES, the operation flow goes to step S110. If NO, the vehicle A waits until the given time period is elapsed.

In step S110, the vehicle communication apparatus 170 in the car navigation system 10 mounted on the vehicle A transmits a request to stop (stop information) using the transmission diffusion code A assigned to the road 2A with double lanes, in order to stop both the on-coming vehicles G and H on the road 2B with double lanes.

The vehicle A thereby transfers a request to stop to both the on-coming vehicles G and H on the road 2B with double lanes that want to approach the single lane road 1*a* through the connection node N2.

In the following case, although the on-coming vehicle G receives the request to stop from the stop vehicle A, the vehicle G approaches and enters to the single lane road 1*a* and is traveling on the single lane road 1*a*.

In step S120, the vehicle communication apparatus 170 mounted on the vehicle A judges whether or not a reply (as "stop response information") to the request to stop is transferred from one of or both the on-coming vehicles G and H. If YES, namely, the stop vehicle A receives the reply (as "stop response information") to the request to stop from one of or both the on-coming vehicles G and H, the operation flow is forwarded to step S130. If NO, namely, the vehicle A does not receive any reply to the request to stop from the on-coming vehicles G and H, the vehicle communication apparatus 170 in the stop vehicle A sends the request to stop to the vehicles G and H on the road 2B with double lanes repeatedly.

The on-coming vehicles G and H have received the request to stop from the stop vehicle A and one or both the vehicles G and H stop on the road 2B with double lanes according to the request. One or both the vehicles G and H transfer to the stop vehicle A the reply (as "stop response information") to the request to stop. By receiving the reply to the request from one or both the on-coming vehicles G and H, the stop vehicle A can recognize that the vehicle that has sent the reply stops completely on the road 2B with double lanes and does not approach the single lane road 1*a*.

That is, the vehicle communication apparatus 170 mounted on each vehicle does not generate and transfer the reply (as "stop response information") to the request to stop unless the vehicle stops completely.

In step S130, the vehicle communication apparatus 170 mounted on the stop vehicle A judges whether or not all of the on-coming vehicles B to F on the single lane road 1*a* and the vehicle G on the road 2B with double lanes have passed through the single lane road 1*a* completely. In the judgment, the stop vehicle A receives the information and reply (as "stop response information") from the on-coming vehicles while using the transmission diffusion codes assigned to the single lane road 1*a*. If the stop vehicle A does not receive the reply from the vehicles using the transmission diffusion codes assigned to the single lane road 1*a*, the vehicle A can judge that the all of the vehicles B to F and G have passed through the single lane road 1*a* completely. Thus, the stop vehicle A can recognize whether or not the vehicle is on the single lane road 1*a* by receiving the reply from the vehicle using the transmission diffusion code assigned to the single lane road 1*a*. If the judgment result indicates YES, namely no vehicle is on the single lane road 1*a*, the operation flow goes to step S140. If NO, the stop vehicle A keeps to stop on the road 2A with double lanes until the all of the vehicles B to G pass through the single lane road 1*a* completely.

In step S140, the vehicle A approaches to, enters to and travels on the single lane road 1*a* after the judgment indicates all of the vehicles B to G have passed through the single lane road 1*a*. Further, the vehicle A transmits to the vehicle H on the road 2B with double lanes the start information regarding approaching to and traveling on the single lane road 1*a*.

The vehicle A can pass through the single lane road 1*a* safety without the wait until the vehicle H passes through the single lane road 1*a* by the vehicle H completely.

Figure 8:
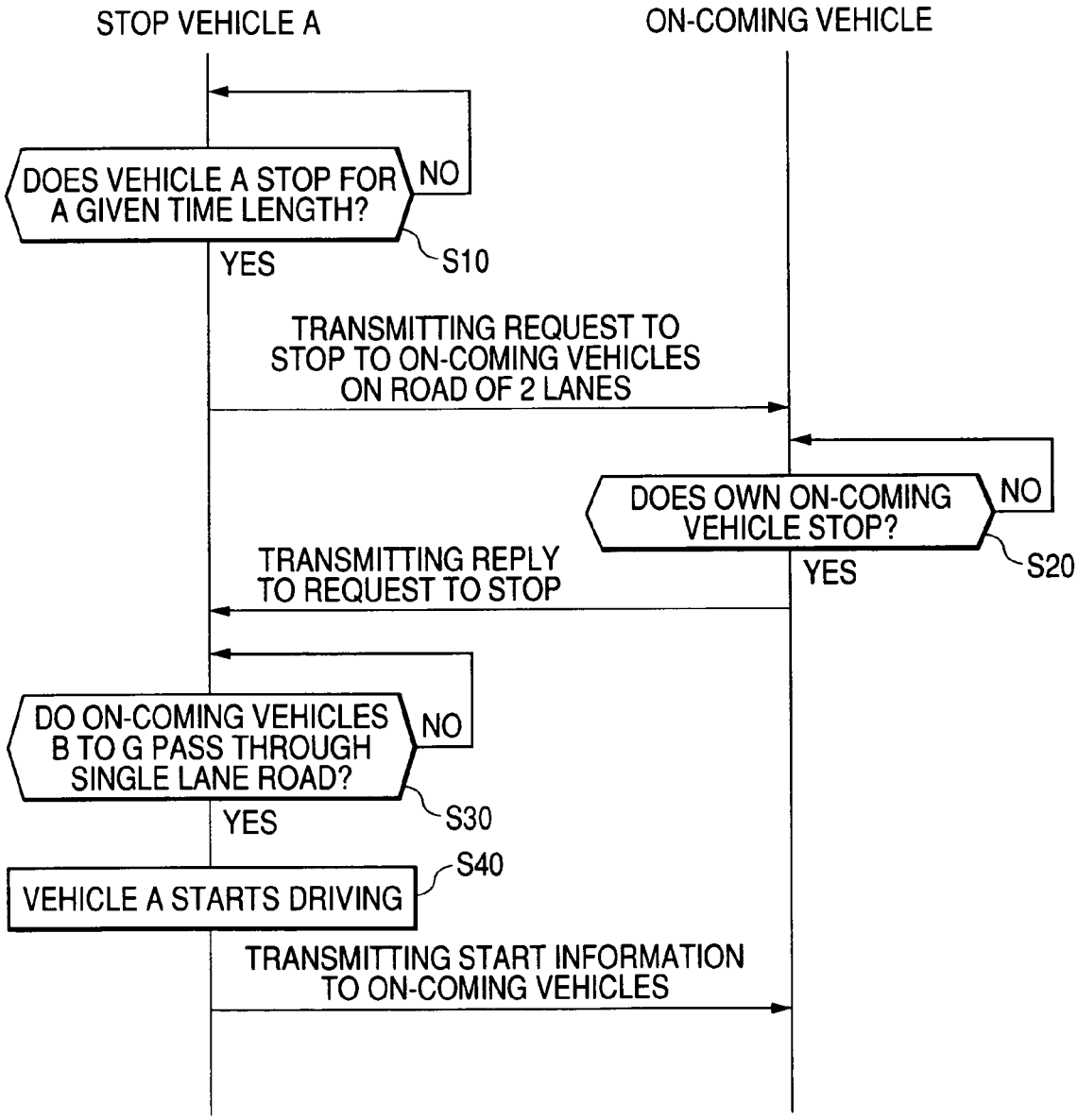
FIG. 8 is a flowchart showing the operation flow of radio communication between own vehicle A and the on-coming vehicles.
Figure 9A:
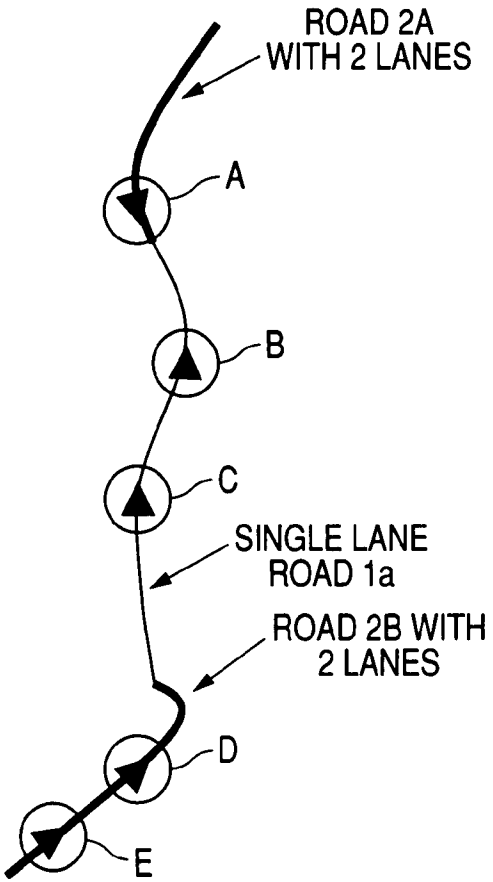
FIG. 9A to FIG. 9C are diagrams showing a trouble not solved by a conventional vehicle communication between own vehicle and on-coming vehicles.
Figure 9B:
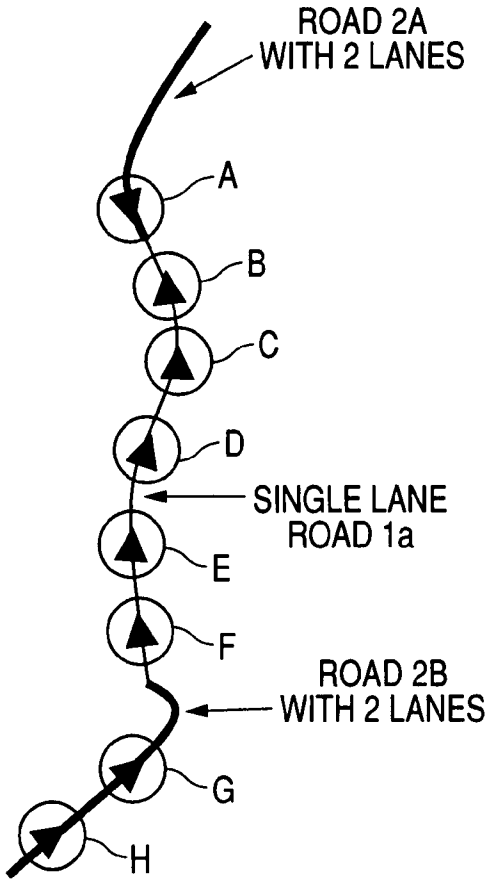
Figure 9C:
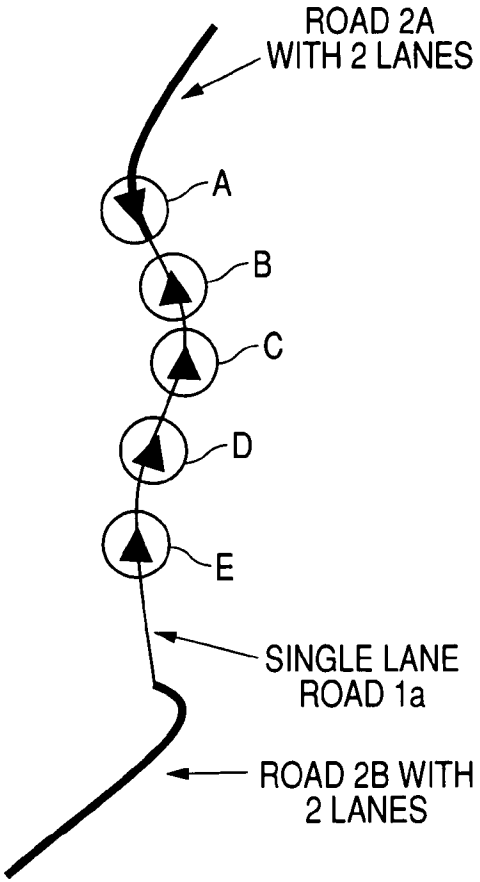

A description will now be given of the communication flow between the vehicle A and the other on-coming vehicles with reference to FIG. 8. Each vehicle is equipped with the car navigation system 10 having the vehicle communication apparatus 170 shown in FIG. 1 and FIG. 2.

First, step S10, the stop vehicle A that stops on the road 2A with double lanes judges whether or not the stop vehicle A stops during a given time length. If NOT, namely the judgment result indicates the stop vehicle A does not stop for the given time period, the stop vehicle A keeps to stop until the given time period is elapsed.

On the contrary, the judgment result indicates that the given time has been elapsed under the stop of the vehicle A. the apparatus 170 mounted on the stop vehicle A transmits the request to stop to the vehicles G and H on the road 2B with double lanes.

In step S20, the vehicle communication apparatus 170 of each of the vehicles G and H judges whether or not the vehicle that has received the request to stop transferred from the stop vehicle A stops on the road 2B with double lanes.

If No, namely, both the on-coming vehicles G and H do not stop on the road 2B with double lanes, the on-coming vehicles G and H perform no operation.

On the contrary, if YES, this means that one of or both the vehicles G and F stop completely on the road 2B with double lanes according to the request to stop from the stop vehicle A.

For example, if the on-coming vehicle G does not transfer the reply to the stop vehicle A because the on-coming vehicle G approaches to the joint node N2 and enters to and travels on the single lane road 1*a* and the on-coming vehicle H stops on the road 2B with double lanes, only the on-coming vehicle H transfer to the stop vehicle A the reply (as "stop response information") to the request from the vehicle A.

In step S30, the stop vehicle A receives the reply only from the vehicle H and then judges whether or not all of the vehicles B to G have passed through the single lane road 1*a*.

If YES, namely all of the vehicles B to G have passed through the single lane road 1*a*, the operation flow goes to step S40. If NO, the vehicle A waits to approach the joint node N1 of the single lane road 1*a* until all of the vehicles B to G pass through the single lane road 1*a* completely.

In step S40, the stop vehicle A starts to approach the single lane road 1*a* and transfers the information that the vehicle A enters the single lane road 1*a* and travels on the single lane road 1*a* to the on-coming vehicle H and following newly on-coming other vehicles I and J (see FIG. 3C and FIG. 4C) that are on the road 2B with double lanes.

As described above, according to the vehicle communication apparatus 170 and the system for supporting vehicles passing through a narrow road, such as the single lane road 1*a*, mounted on the car navigation system 10 of the embodiment according to the present invention, different transmission diffusion codes are assigned to each road such as the single lane road 1*a*, the roads 2A and 2B with double lanes. Each vehicle switches to the transmission different code assigned to the road on which own vehicle travels, and transfers various information to other vehicles using those transmission diffusion codes. All of the other vehicles are also equipped with the car navigation system 10 having the vehicle communication apparatus 170 and the system for supporting vehicles passing through a narrow road.

As shown in FIG. 3A, even if many on-coming vehicles B to H travels in line, each vehicle uses the different transmission diffusion codes assigned to each road on which own vehicle travels. Further, if there is no unused transmission diffusion code assigned to a road, the radio wave interference does not occurs between the vehicles that are currently travel in a same direction on this road because the vehicle communication apparatus 170 mounted on each vehicle inhibits the data transmission using the transmission diffusion codes assigned to this road.

Thus, the configuration of the car navigation system having the vehicle communication apparatus of the embodiment according to the present invention can avoid any occurrence of radio interference between the vehicles and avoid the lacking of communication channels.

As a result, the stop vehicle A can perform the recognition of the presence and position of the on-coming vehicles on the single lane and the roads 2A and 2B with double lanes, and can communicate with each other.

Further, according to the present invention, because the vehicles on the roads 2A and 2B with double lanes perform communication using the transmission diffusion codes that corresponds to the approach direction to the single lane road 1*a*, it is possible to judges based on the reception diffusion codes the traveling direction of the on coming vehicle, namely whether the on-coming vehicle travels from which road with double lane to the single lane road 1*a*.

Further, the present invention is not limited by the above manner and configuration. It is acceptable to perform the following manner instead of the assignment scheme of the transmission diffusion codes to each road. For example, the car navigation system 10 receives transmission channel data items from an external traffic center such as a VICS center or beacons embedded in the road, and performs the correspondence between the road data items stored in the car navigation system 10 with the transmission channel data items received. Furthermore, if a vehicle obtains a transmission channel data in a road building where a temporal single lane road happens, it is possible to delete the transmission channel data after a given time period (24 hours later) is elapsed.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalent thereof.

What is claimed is:

1. A vehicle communication apparatus mounted on a vehicle configured to communicate with other vehicles using transmission channels and receiving channels, wherein different transmission channels are assigned to roads, respectively, and the roads include a single lane road, a first approach road, and a second approach road, one end of the single lane road is joined to the first approach road, the other end of the single lane road is joined to the second approach road, wherein the single lane road is characterized by two vehicles being substantially unable to pass each other thereon, wherein the first and second approach roads are characterized by two vehicles being able to pass each other thereon, the vehicle communication apparatus comprising:

road recognition means configured to recognize a road on which the vehicle equipped with the vehicle communication apparatus exists or is running;

transmission channel switching means configured to switch to a transmission channel assigned to the road recognized by the road recognition means when a transmission of information is initiated to other vehicles; and vehicle communication means configured to communicate with on-coming vehicles among the other vehicles which travel on at least one of the single lane road and the second approach road using the transmission channel switched to by the transmission channel switching means.

2. The vehicle communication apparatus according to claim 1, further comprising:

road data memory means configured to store road data including position data regarding positions of the single lane road, the first and second approach roads, and transmission channel data indicating the transmission channels assigned to the single lane road and the first and second approach roads; and position detection means configured to detect a current position of the vehicle on the road, wherein the road recognition means recognizes the road corresponding to the current position of the vehicle detected by the position detection means.

3. The vehicle communication apparatus according to claim 2, further comprising transmission channel recognition means configured to recognize the transmission channel assigned to the road which is recognized by the road recognition means based on the road data including the transmission channel data, wherein the transmission channel switching means switches to the transmission channel recognized by the transmission channel recognition means as the transmission channel to be used by the vehicle communication means.

4. The vehicle communication apparatus according to claim 1, wherein the transmission channel assigned to each of the single lane road and the first and second approach roads includes a predetermined number of different transmission channels, and the transmission channel switching means switches to a currently unused transmission channel of the predetermined number of different transmission channels assigned to the road recognized by the road recognition means.

5. The vehicle communication apparatus according to claim 2, wherein the transmission channel assigned to each of the single lane road and the first and second approach roads includes a predetermined number of different transmission channels, and the transmission channel switching means switches to a currently unused transmission channel of the predetermined number of different transmission channels assigned to the road recognized by the road recognition means.

6. The vehicle communication apparatus according to claim 3, wherein the transmission channel assigned to each of the single lane road and the first and second approach roads includes a predetermined number of different transmission channels, and the transmission channel switching means switches to a currently unused transmission channel of the predetermined number of different transmission channels assigned to the road recognized by the road recognition means.

7. The vehicle communication apparatus according to claim 4, wherein the transmission channel switching means switches to one of the transmission channels of the predetermined number of different transmission channels even if all of the transmission channels assigned to the road recognized by the road recognition means are currently used, and the vehicle communication means further comprises transmission inhibiting means configured to halt the transmission of information using the transmission channel switched by the transmission channel switching means while this transmission channel is used.

8. The vehicle communication apparatus according to claim 7, wherein vehicle communication means receives information transferred from the other vehicles using the transmission channels assigned to the single lane road and the first and second approach roads regardless of inhibition of the transmission of information by the transmission inhibiting means.

9. The vehicle communication apparatus according to claim 1, wherein the vehicle communication means transmits and receives information based on a spectrum communication scheme using diffusion codes, and the transmission channel switching means switches to a diffusion code as the different transmission channel assigned to each of the single lane road and the first and second approach roads, and the vehicle communication means transmits and receives information using the diffusion code to be used for the transmission channel switched by the transmission channel switching means.

10. A system for assisting a plurality of vehicles passing through a single lane load, where one end of the single lane road is joined to a first approach road and the other end of the single lane road is joined to a second approach road, wherein the single lane road is characterized by two vehicles being unable to pass each other thereon, wherein the first and second approach roads are characterized by two vehicles being able to pass each other thereon, wherein each of the plurality of vehicles is equipped with a vehicle communication apparatus capable of communicating with other vehicles of the plurality of vehicles using different transmission channels assigned to the single lane road, the first approach road, and the second approach road, respectively, the vehicle communication apparatus comprising:

road recognition means configured to recognize the first approach road on which the vehicle of the vehicle communication apparatus is currently disposed;

transmission channel switching means configured to switch to a transmission channel assigned to the first approach road recognized by the road recognition means when the vehicle initiates a transmission of information to other vehicles of the plurality of vehicles; and vehicle communication means configured to communicate with the other vehicles including on-coming vehicles disposed on at least one of the single lane road and the second approach road using the transmission channel switched by the transmission channel switching means, wherein a vehicle stop request signal is transmitted to the on-coming vehicles on the second approach road when the vehicle is disposed on the first approach road and is going to enter the single lane road, and each of the on-coming vehicles on the second approach road transmits a response signal to the vehicle when receiving the vehicle stop request signal and stops based on the vehicle stop request signal received.

11. The system according to claim 10, wherein the vehicle on the first approach road transfers the vehicle stop request signal to the other vehicles when the vehicle stops within a given distance measured from a joint point between the first approach road and the single lane road.

12. The system according to claim 11, wherein the vehicle receives response information from each on-coming vehicle on the single lane road using the transmission channel assigned to the single lane road, and determines that no on-coming vehicle is disposed on the single lane road when no response information is received using the transmission channel assigned to the single lane road.

13. The system according to claim 12, wherein the vehicle transmits start information that the vehicle is entering the single lane road to the on-coming vehicles on the second approach road when no response information is received using the transmission channel assigned to the single lane road.

14. The system according to claim 13, wherein the vehicle transmits the start information to the on-coming vehicles on the second approach road using a transmission channel assigned to the second approach road.

15. A vehicle communication apparatus mounted on a vehicle configured to communicate with other vehicles using transmission channels and receiving channels, wherein different transmission channels are assigned to roads, respectively, and the roads include a single lane road, a first approach road, and a second approach road, one end of the single lane road is joined to the first approach road, the other end of the single lane road is joined to the second approach road, wherein the single lane road is characterized by two vehicles being substantially unable to pass each other thereon, wherein the first and second approach roads are characterized by two vehicles being able to pass each other thereon, the vehicle communication apparatus comprising:

road recognition means configured to recognize a road on which the vehicle equipped with the vehicle communication apparatus is currently disposed as one of the single lane road, the first approach road, and the second approach road;

transmission channel switching means configured to switch to a transmission channel assigned to the road recognized by the road recognition means when a transmission of information is initiated to the other vehicles; and vehicle communication means configured to:

communicate with on-coming vehicles among the other vehicles which travel on at least one of the single lane road and the second approach road using the transmission channel switched to by the transmission channel switching means when the road on which the vehicle is currently disposed is recognized as the first approach road by the road recognition means;

transmit a vehicle stop request signal to the on-coming vehicles on the second approach road when the road on which the vehicle is currently disposed is recognized as the first approach road by the road recognition means and the vehicle is going to enter the single lane road; and transmit a response signal in response to a received vehicle stop request signal indicating that the vehicle will stop when the road on which the vehicle is currently disposed is recognized as the second approach road by the road recognition means.

16. The vehicle communication apparatus according to claim 15, wherein the vehicle communication means transmits and receives information based on code division multiple access (CDMA) using a plurality of diffusion codes, the transmission channel switching means switches to a different diffusion code of the plurality of diffusion codes as the different transmission channel assigned to each of the single lane road and the first and second approach roads, and the vehicle communication means transmits and receives information using the different diffusion code for the transmission channel switched to by the transmission channel switching means.

17. The vehicle communication apparatus according to claim 15, wherein the transmission channel assigned to each of the single lane road and the first and second approach roads includes a predetermined number of different transmission channels accessible by a predetermined number of code division multiple access (CDMA) diffusion codes, and the transmission channel switching means switches to a currently unused transmission channel of the predetermined number of different transmission channels assigned to the road recognized by the road recognition means.

* * * * *